US006910588B2

(12) United States Patent
Ermekova et al.

(10) Patent No.: US 6,910,588 B2
(45) Date of Patent: Jun. 28, 2005

(54) MINERAL PROCESSING DEVICE

(75) Inventors: Gulnar Ermekova, Karaganda (KZ); Burkit Mainin, mikroraion Kungei, 574, 470074 Karaganda (KZ); Zhanat Mainina, Karaganda (KZ); Zhibek Mainina, Karaganda (KZ)

(73) Assignee: Burkit Mainin, Karaganda (KZ)

( * ) Notice: Subject to any disclaimer, the term of this patent is extended or adjusted under 35 U.S.C. 154(b) by 0 days.

(21) Appl. No.: 10/677,899

(22) Filed: Oct. 2, 2003

(65) Prior Publication Data

US 2004/0112801 A1 Jun. 17, 2004

Related U.S. Application Data

(63) Continuation of application No. PCT/KZ02/00001, filed on Jan. 21, 2002.

(30) Foreign Application Priority Data

Apr. 6, 2001 (KZ) ..... 2001/0491

(51) Int. Cl.[7] ..... B07B 1/00
(52) U.S. Cl. ..... 209/405; 209/409
(58) Field of Search ..... 209/13, 325–327, 209/331, 332, 365.1, 365.2, 373, 378, 380, 405, 425, 427, 409, 448, 449

(56) References Cited

U.S. PATENT DOCUMENTS 236,730 A * 1/1881 Stephens ..... 209/475
276,534 A * 4/1883 Hershey et al. ..... 209/479
307,753 A * 11/1884 Nevins ..... 137/369
506,751 A * 10/1893 Wall ..... 209/427
2,285,678 A * 6/1942 Overstrom et al. ..... 209/315
4,319,990 A * 3/1982 Muller ..... 209/240
6,234,319 B1 * 5/2001 Wang ..... 209/479
6,508,364 B2 * 1/2003 Kreft et al. ..... 209/309

FOREIGN PATENT DOCUMENTS

DE 3611234 C1 * 10/1987 ..... B07B/1/46
JP 04180873 A * 6/1992 ..... B07B/1/55
WO WO 2062480 A2 * 8/2002

* cited by examiner

*Primary Examiner*—Donald P. Walsh
*Assistant Examiner*—Joseph Rodriguez
(74) *Attorney, Agent, or Firm*—Fraser Martin Buchanan Miller LLC

(57) ABSTRACT

A machine for the processing of minerals using a gravitational method, which can be used in ore and coal mining as well as in other industries. The machine has a unit for loading material to be processed, a unit for unloading the products processed, a drive, a unit for delivering working medium, elastic elements, a box with jigging sieve and tub with working medium connected between each other by rigid mobile elements and supports. The design of the machine provides stability and intensification of jigging process. Besides, there is a considerable decrease of energy consumption and simplicity in the design. A pilot sample of the machine has been made, and testing showed good technological results of processing and proved its high reliability productivity.

6 Claims, 1 Drawing Sheet

MINERAL PROCESSING DEVICE

This application is a continuation of international application number PCT KZ02/00001, filed Jan. 21, 2002 (status, abandoned, pending, etc.).

FIELD OF THE INVENTION

This paper is dealing with processing minerals by gravitational method and can be used in ore and coal mining as well as in some other industries.

BACKGROUND OF THE INVENTION

There is a certain device for gravitational method of processing, "The WEMCO REMER JIG" (Machine Design <<The WEMKO REMER JIG>> WEMCO EQUIPMENT, COAL PLANTS 315C Street, St. Albans, West). It consists of an unmovable trough with sieve and a movable tub with water both are being connected by rubber diaphragm along perimeter. This tub with water is being given vertical reciprocating movement by means of special doubled eccentric mechanism. As a result vertical pulsation of under-sieve water is being achieved that is very important for jigging.

The disadvantages of the machine are the complexity of the design due to the eccentric unit construction, high inertia of the lower part of the machine, that results in high energy-consumption because of the fact that each cycle of jigging needs tub up going with the whole capacity of water as well as low efficiency of mineral processed as there is no simultaneous uprising of the whole bed characteristic of all jiggers with unmovable trough.

There is a device with gravitational processing, a prototype of a jigger for undermining where simultaneously both jigging sieve and working medium (water) pulsate (Chalenko A.—New tendencies in designing jiggers with mobile sieve: Moscow, TSNEETEItyazhmash, 1991, (Mining Equipment, series 2, No. 3, 12).

The machine consists of a unit for loading of material to be processed, a units for unloading material processed, a unit for delivering working medium, a box with a jigging sieve and a tub with the working medium, connected between each other by flexible elastic elements (flat springs) and a drive. The tub has a support shaped as a frame with the shock-absorbers. The machine is a double-mass oscillating system with elastic connection between the masses because of which the jigging sieve and working medium oscillate in counter-phase and it provides their simultaneous pulsation. Along with vertical pulsation of the under-sieve water and vertical pulsation of the jigging sieve simultaneous uprising of the whole bed is being achieved that is very important for jigging process (Bert R. Technology of gravitational processing: Translation from English/Moscow, Nedra, 1990.-219, 220).

Disadvantage for the device is instability of oscillation regime of the working unit and working medium—amplitude of oscillating jigging sieves and water—that influences negatively effectiveness of jigging process, namely decreasing the quality of products dressed as well as there are certain limits in frequency and amplitude of oscillations that decreases the possibility of the further intensification of jigging process for ores with high specific gravity. This is the consequence of the fact that the oscillations of jigging sieve and working medium are being fixed relatively to the center of gravity of a jigger.

As this machine is a double-mass one with elastic connection between masses (by means of flat spring), according to the theory of oscillation of mechanical systems (Vibration in technique. Moscow: machine building, 1978, v.4, part 2, ch.6, p.140, FIG. 5) its work will be characterized by instability of oscillating regime that results in instability of jigging process and as a consequence decreasing of the quality of products dressed. Increasing of amplitude and frequency of oscillation results in greater instability of oscillation regime.

SUMMARY OF THE INVENTION

The technical purpose of invention is designing a simple device for gravitational processing of minerals, providing stability and intensification of the process mentioned.

This purpose is being achieved by connecting the box with the jigging sieve and the tub with the working medium connect between each other movably by means of one or more rigid elements (eg, by means of double-arm levers, etc), while at least one of the rigid mobile elements is being installed upon support movably, and elastic elements connect either two or more mobile units of the machine between each other or the support with one or more mobile units, there must being not less than one elastic element. As an example, on FIG. 1 there is a cinematic scheme of a hinged 4-link unit with rigid mobile elements in the form of double-arm levers and an elastic element in the form of coiled spring.

As we see on FIG. 1 introduction into the construction of the prototype of rigid mobile elements provides the machine with stability of the oscillation regime of operating units, as the movement of the box with the sieve and the tub with working medium has been calculated concerning rotation supports of double-arm levers. In the machine under discussion elastic elements fulfill the job of balancing power and depending on a certain combination and inertia moments of oscillating parts of the machine, necessary balance can be achieved by means of connecting two or more mobile parts by elastic elements or its mobile parts with the support.

DETAILED DESCRIPTION OF THE INVENTION

Figure 1:
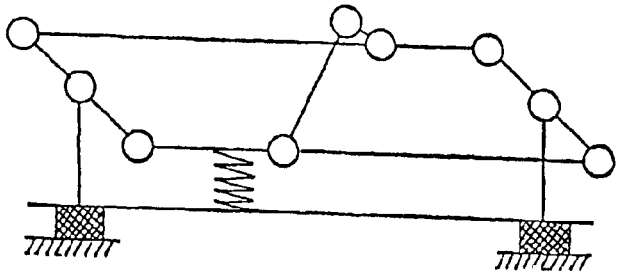
FIG. 1—cinematic scheme of the machine.
Figure 2:
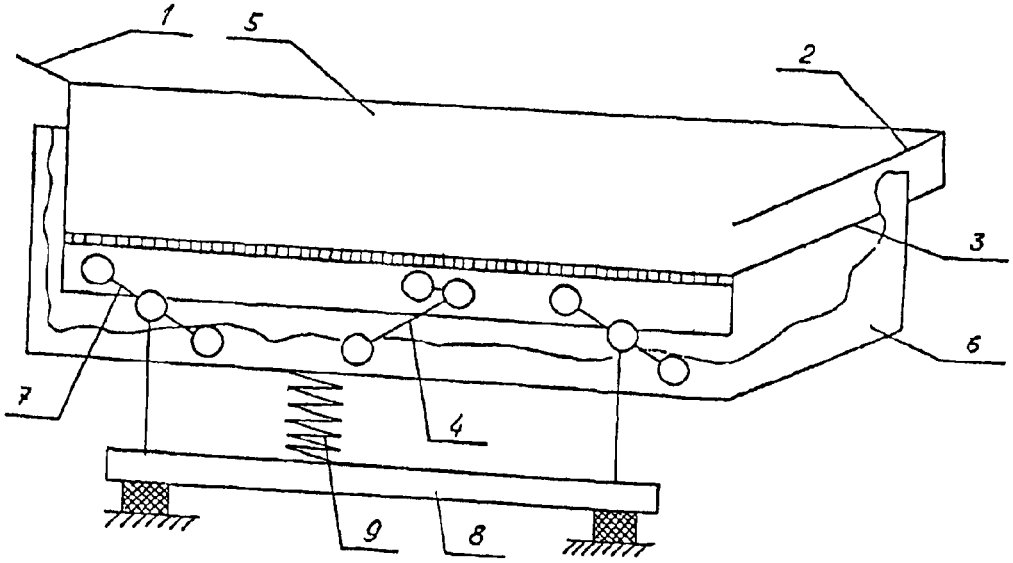
FIG. 2—design of the machine, side sight.

The machine under discussion (FIG. 2) has a unit for loading material to be processed, units for unloading products processed (2 and 3) (the device for unloading under sieve fines is not shown), drive 4 (as one of the variant slider-crank mechanism), box with jigging sieve and tub with working medium 6, connected between each other by rigid mobile elements 7 (as one of the variants—double-arm levers with the equal length of arm), these rigid mobile elements being fixed on the support 8, the support is connected to the tub by means of elastic elements 9 (as one of the variants coiled spring). Working medium is being transferred through unit 10 (not shown).

The designed machine operates in the following way: mineral to be processed is being transported out of loading unit 1 into the box with jigging sieve 5. Drive 4 transfers oscillating movement both to box with jigging sieve 5 and to tub with working medium 6.

Synchronically with traveling tub with working medium 6 downwards there is movements of box with jigging sieve 5 upwards that results in uprising of the whole bed. On traveling box with jigging sieve 5 downwards, tub with working medium 6 travels synchronically upwards that results in vertical pulsation of under–sieve+water. Products processed are being taken away trough unloading units 2 and 3. While unloading of products processed, the loss of working medium is being compensated by its permanent delivery trough unit 10. Stability of oscillation regime of box with jigging sieve and tub with working medium is provided by slider-crank mechanism and rigid mobile elements 7. The whole construction of the design is cinematically balanced by elastic element 9.

As a drive hydro-cylinders can be used, as well as weir revolting hydro-engines and some other devices. As working medium water, heavy-medium suspension or some other material can be used. As for elastic elements such material as springs, multiple-leaf springs, elastic diaphragm and other elements can be used, while elastic elements can bind box with tub, support with box or tub box or tub with rigid mobile element, the latter with support, etc. Installing additional devices for unloading gives possibility of getting any required quantity of products processed.

Industrial Usage

The peculiarities of the design under discussion are very substantial, as they provide the possibility of stabilization and intensification of jigging process. Its industrial usage is out of discussion.

Cinematic scheme of the machine provides it with the requirements to treat it as oscillating system with the criterions of stability, balance and power factor.

Besides, cinematic scheme of the machine permits to increase greatly its capacity simply by enlarging its size (both in width and length) without substantial complication of the construction. At present a pilot sample has been made and its tests showed good technological results and confirmed the reliability of the device, simple in producing, using and manufacturing.

What is claimed is:

1. A machine for gravitational processing of mineral deposits, comprising:

a movable box having a jigging sieve therein;

a movable tub containing working medium;

at least one rigid mobile element movably interconnecting the box and the tub;

at least one support movably carrying the at least one rigid mobile element;

a drive capable of actuating the at least one rigid mobile element relative to the support, in order to move the box and the tub relative to each other in an oscillating motion;

at least one elastic element acting upon at least one of one of the box, the tub, the rigid mobile element and the support; and a unit for loading materials to be processed, a unit for unloading processed products, and a unit for delivering the working medium to the tub;

wherein the elastic element can maintain the oscillating motion of the box and the tub in order to achieve stability and intensification of the jigging process.

2. The machine according to claim 1, wherein both the rigid mobile element is a double arm lever, and the tub and the box are pivotally interconnected by the double arm lever, and wherein the double arm lever is pivotally mounted on the support.

3. The machine according to claim 1, wherein the elastic element binds the box with the tub.

4. The machine according to claim 1, wherein the elastic element binds the support with the box.

5. The machine according to claim 1, wherein the elastic element binds the support with the box.

6. The machine according to claim 1, wherein the elastic element binds the support with the rigid mobile element.

* * * * *